US005920929A

United States Patent [19]

Hensley et al.

[11] Patent Number: 5,920,929

[45] Date of Patent: Jul. 13, 1999

[54] IMMOBILE-PATIENT TRANSFER DEVICE

[75] Inventors: Terry L. Hensley; Amy A. Hensley, both of Clear Creek, Ind.

[73] Assignee: Henwood Corporation, Clear Creek, Ind.

[21] Appl. No.: 08/980,729

[22] Filed: Dec. 1, 1997

[51] Int. Cl.[6] ..... A61G 7/10

[52] U.S. Cl. ..... 5/81.1 T; 5/81.1 R; 5/81.1 HS; 5/485

[58] Field of Search ..... 5/81.1 R, 81.1 HS, 5/81.1 T, 89.1, 485, 926

[56] References Cited

U.S. PATENT DOCUMENTS

| | | | |
|---|---|---|---|
| 3,284,816 | 11/1966 | Laubsch . | |
| 3,829,914 | 8/1974 | Treat . | |
| 3,978,531 | 9/1976 | Ilon . | |
| 4,084,275 | 4/1978 | Ilon . | |
| 4,336,621 | 6/1982 | Schwartz et al. . | |
| 4,744,115 | 5/1988 | Marchione . | |
| 4,822,667 | 4/1989 | Goad et al. . | |
| 4,872,226 | 10/1989 | Lonardo | 5/81.1 T |
| 4,991,232 | 2/1991 | Taylor . | |
| 5,001,785 | 3/1991 | Heiman et al. . | |
| 5,024,851 | 6/1991 | Goad et al. . | |
| 5,148,558 | 9/1992 | Dunn . | |
| 5,165,122 | 11/1992 | Phalen | 5/81.1 T |
| 5,183,702 | 2/1993 | Taylor et al. . | |
| 5,222,507 | 6/1993 | Taylor . | |
| 5,236,532 | 8/1993 | Taylor et al. . | |
| 5,244,718 | 9/1993 | Taylor et al. . | |
| 5,269,324 | 12/1993 | Butterfield . | |
| 5,271,110 | 12/1993 | Newman | 5/81.1 R |
| 5,279,009 | 1/1994 | Putka, Jr. | 5/485 |
| 5,329,655 | 7/1994 | Garner . | |
| 5,442,821 | 8/1995 | Weeks | 5/89.1 X |
| 5,511,255 | 4/1996 | Schuerch . | |
| 5,615,425 | 4/1997 | Corente | 5/81.1 T |

*Primary Examiner*—Michael F. Trettel
*Attorney, Agent, or Firm*—Woodard, Emhardt, Naughton, Moriarty & McNett

[57] ABSTRACT

A device for transferring a person from one surface, such as an ambulance cot, to a second surface, such as a hospital bed. The device is a sheet that fits the elongate transferor surface, upon which the person rests initially, in a contour sheet manner. A plurality of straps are anchored to the sheet and may be stored in longitudinally extending pouches at the sides of the sheet. The pouches are made of a fabric netting material, one end of which is stitched to the sheet. The pouches are opened and closed using strips of hook and loop fastening material, one strip attached to the other end of the netting material, and the mating strip attached to the sheet. The straps are long enough to pull over the sheet, the person lying on it, and a transferee surface positioned side-by-side with the transferor surface, so that the straps may be gripped by an attendant at a side of said transferee surface.

23 Claims, 11 Drawing Sheets

IMMOBILE-PATIENT TRANSFER DEVICE

BACKGROUND OF THE INVENTION

This invention relates generally to healthcare and more particularly to a system to facilitate the movement of a patient from one cushioned bed-like surface to another.

In the work of attending to and caring for patients, there are many instances when a patient who is lying on an ambulance cot or a bed is unable to move. When it becomes necessary to move the patient from an ambulance cot to a hospital bed, or from one hospital bed to another, it is necessary for at least two people to move the patient. Typically, where it is a transfer from cot to bed, at least one person is on the far side of the bed and the other is on the far side of the cot. The person on the bed side pulls and the person on the cot side pushes.

One method used sometimes to move a person from a cot to a bed or from a bed to a bed, is for the person on the bed side to roll-up the edge of the sheet on which the patient is lying, grip it in each hand, and pull the sheet as the person on the cot side pushes the patient so that the sheet with the patient on it is transferred. For heavier patients, it often takes at least two people on one or both sides of the bed and the cot. During these types of transfers, it is usually necessary for the attendants to lean forward while pushing or pulling, resulting in risk of a back sprain. The purpose of the present invention is to make the task of moving a patient from one type of bed to another, easier to perform.

SUMMARY OF THE INVENTION

Described briefly, according to a typical embodiment of the present invention, a sheet of material of a size and construction to fit the cushion (a mattress or pad, for example) from which the patient is intended to be transferred in a contour sheet manner, has pockets or pouches along the sides of the sheet. The pockets are arranged so that, when the sheet is on the transferor cushion, the pockets are at the side of the transferor cushion. Straps are stored in the pockets. Each of the straps is anchored to the sheet at the side in which it is stored but is of a sufficient length that the free end thereof can be pulled out of the pocket and the strap end brought entirely over the transferor cushion and a patient lying on the sheet and over another transferee cushion side-by-side with the one cushion so that it can be gripped by an attendant standing at the side of the transferee cushion.

DESCRIPTION OF THE PREFERRED EMBODIMENT

Figure 1:
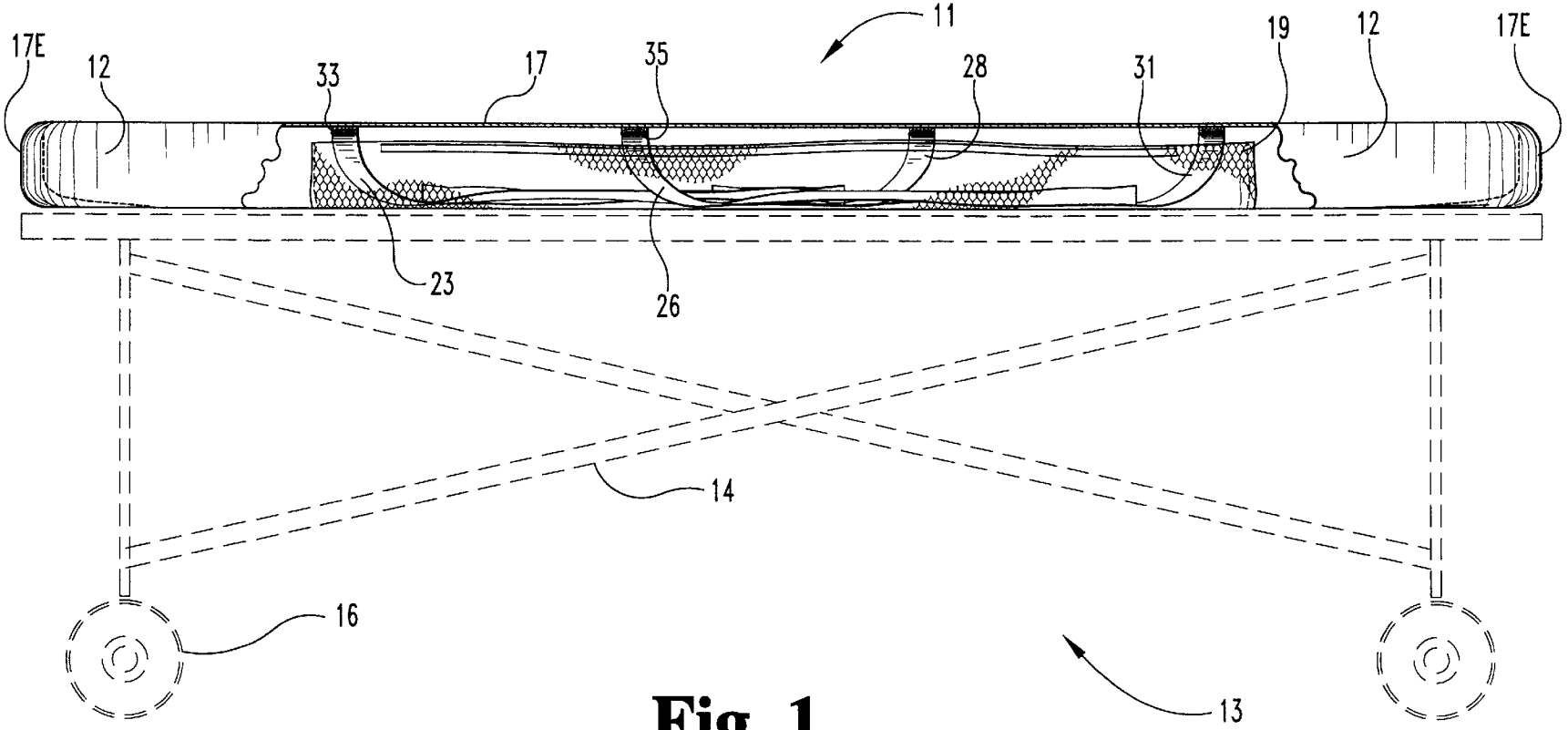
FIG. 1 is a schematic side elevational view of an ambulance cot with the patient transfer device according to a typical embodiment of the present invention installed (shown in longitudinal section) on the cushioning pad (shown fragmented view).

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring now to the drawings in detail, FIG. 1 schematically shows in longitudinal section a patient transfer device 11 mounted on the cushion 12 of the ambulance cot 13 (shown in dashed outline) which, for example, has four folding legs 14 with caster wheels 16 at their lower ends.

Figure 2:
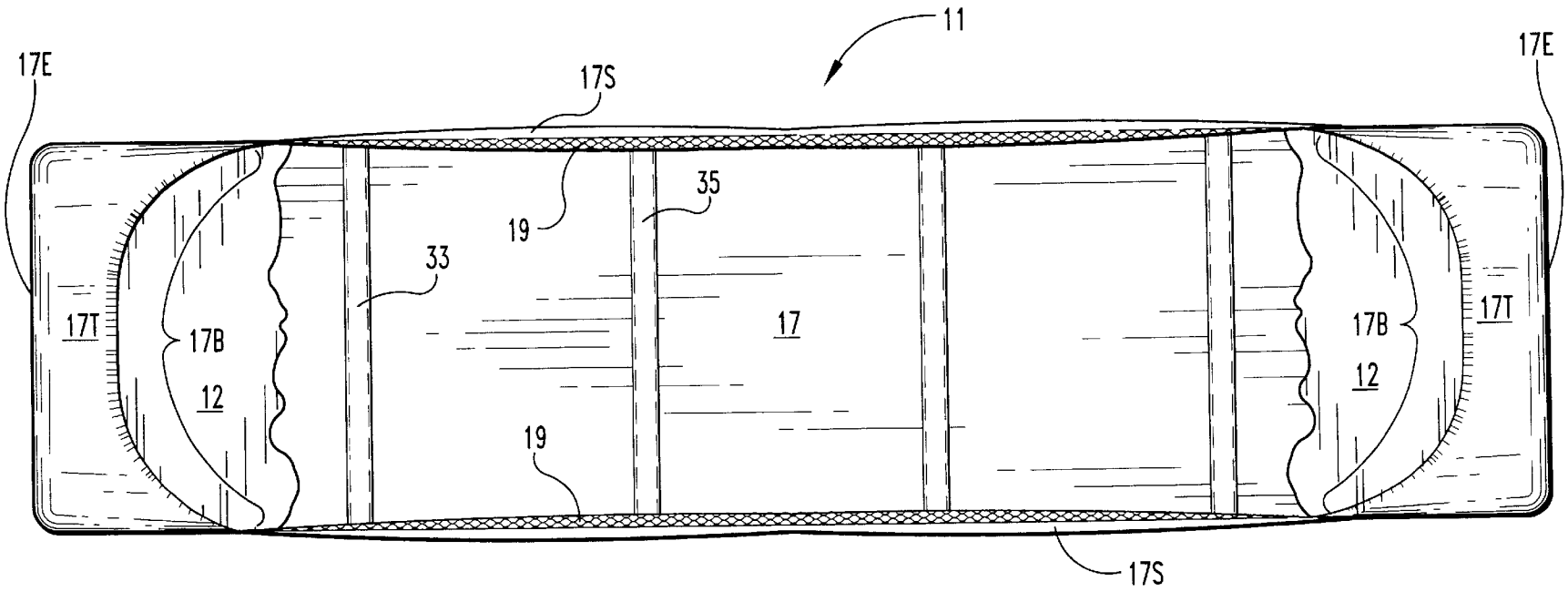
FIG. 2 is a bottom plan view but omitting the undercarriage of the cot and with the central portion of the cushioning pad broken cut to show the underside of a portion of the transfer device.

The bottom view shown in FIG. 2 eliminates the cot itself except for the cushion 12. The transfer device 11 includes a sheet 17 preferably of a woven medical fabric material such as disclosed in U.S. Pat. No. 4,822,667 issued Apr. 18, 1989 and marketed by Standard Textile Company, Inc. This sheet is cut in a pattern such as shown generally in FIG. 9 and stitched together in somewhat the shape and manner of a fitted or "contour" sheet. Thus, when mounted to a cushion the sides 17S and ends 17E make it look very much like a standard fitted sheet. The ends tuck under the cushion as shown at 17T much farther than with standard fitted sheets, and an elastic band or the like 17B is provided at the edge of the end under the cushion to securely retain the sheet on the cushion. In contrast, although the ends of the side panels 17S are stitched to the end panels 17T, they do not tuck under the cushion throughout its length as do the sides of a fitted sheet. This provides space at the sides for pouches 18 at each side of the sheet. These are formed, referring to FIGS. 1 & 6, by using a fabric netting material 19 and stitching it to the inside of the sheet with the bottom margin adjacent bottom edge 19L of the netting material stitched to the sheet margin adjacent the bottom edge of the sheet side 17S. One strip 21 of hook-and-loop fastening material is stitched to the top edge 19T of the netting. A mating strip 22 of hook and loop fastening material is stitched to the inside of the sheet side 17S adjacent the strip 21. Such hook-and-loop material is probably best known and marketed under the brand Velcro.

In an alternative embodiment the top edge of the fabric netting material 19T may be stitched to the sheet a few inches up from the bottom edge of the sheet side 17S and the strip 21 of hook-and-loop fastening material may be stitched to the bottom edge 19L of the netting. The mating strip 22 is stitched to the inside of the bottom edge of the sheet side 17S. In this alternate embodiment, the pouch opens down and in the first embodiment, the pouch opens up.

Figure 4:
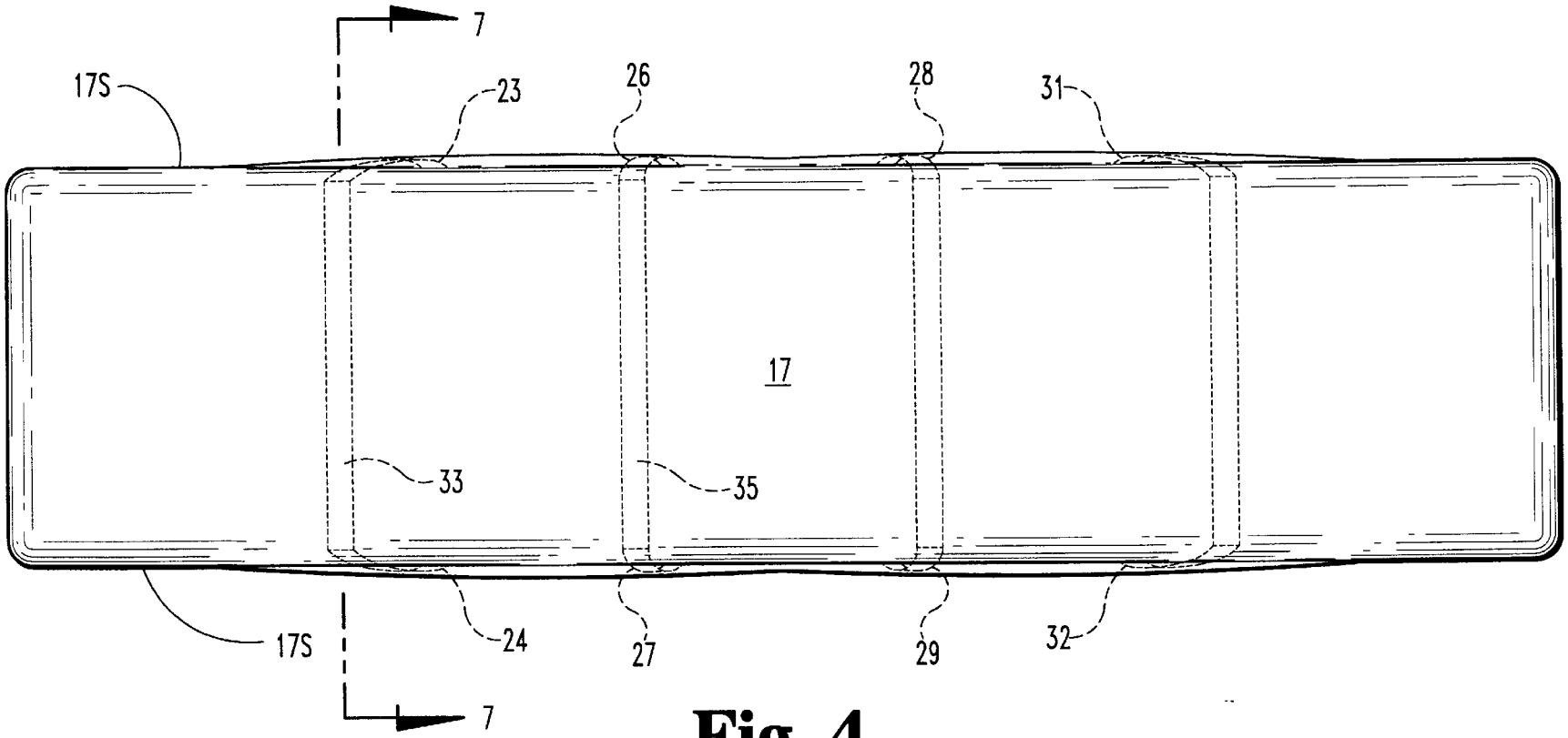
FIG. 4 is a top plan view of the transfer device with the operating straps contained in hidden pouches.
Figure 5:
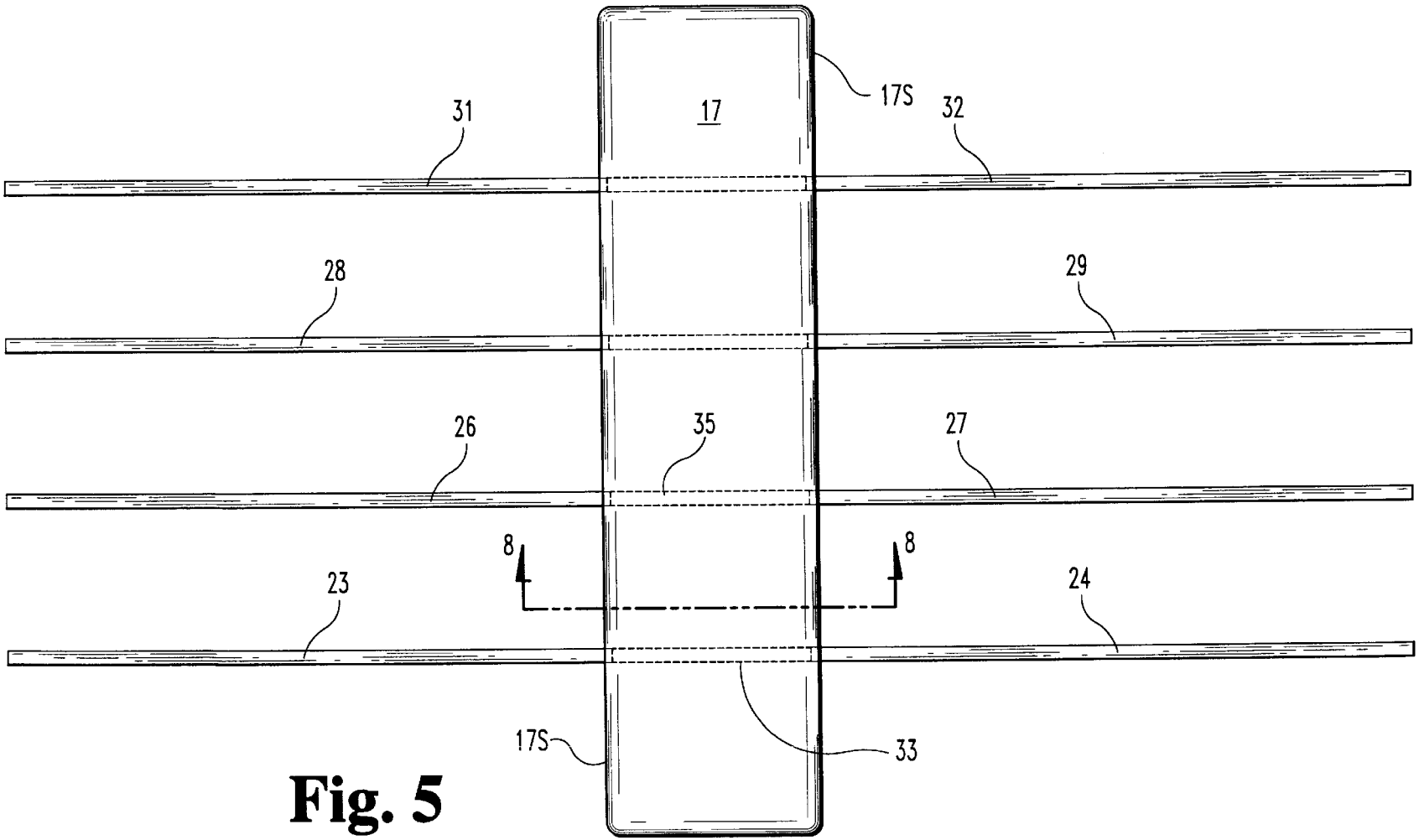
FIG. 5 is a top plan view of the transfer device with the operating straps extended.
Figure 6:
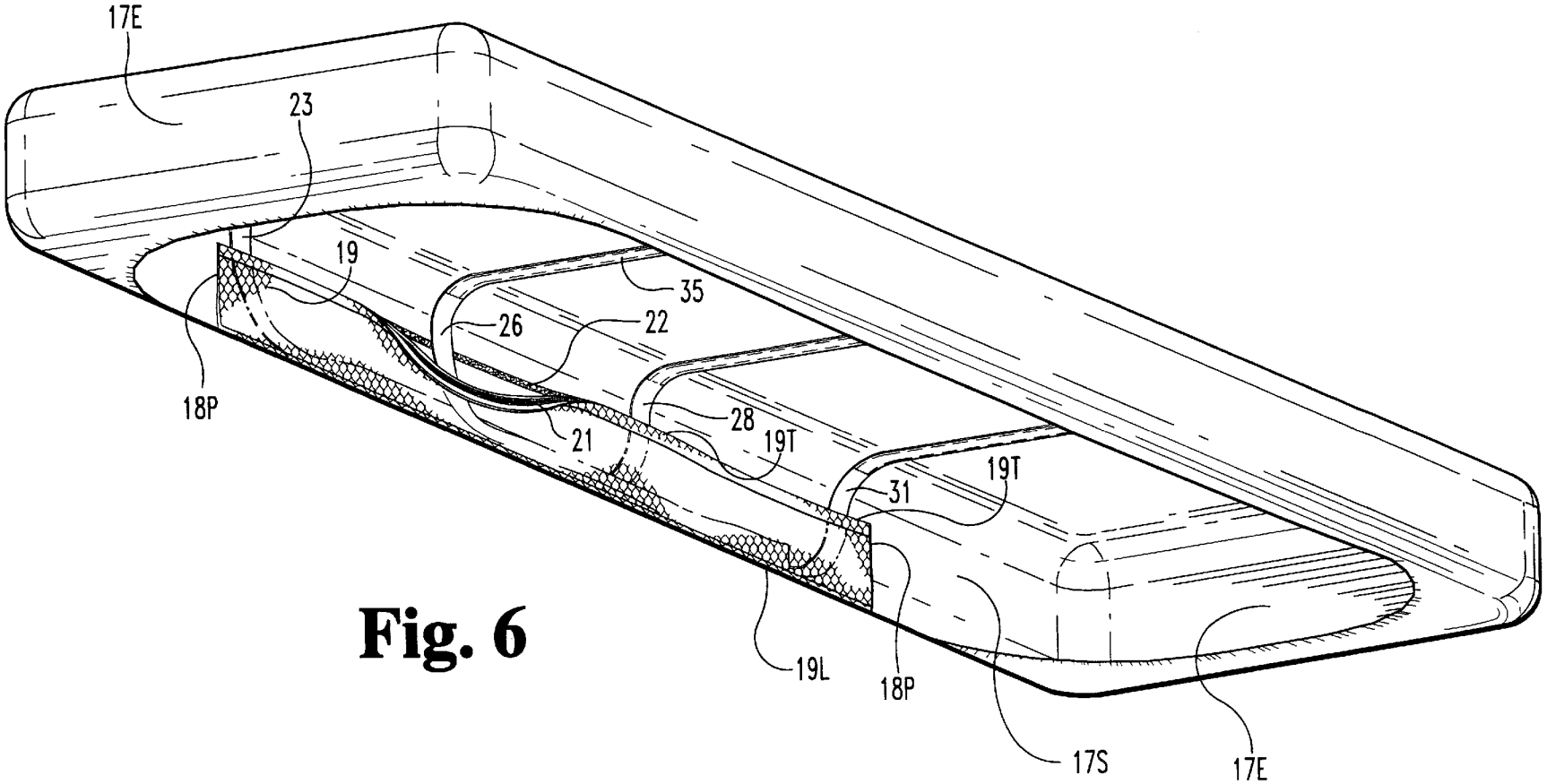
FIG. 6 is a perspective phantom view showing the transfer device as installed on a cushion but without showing the cushion.
Figure 7:
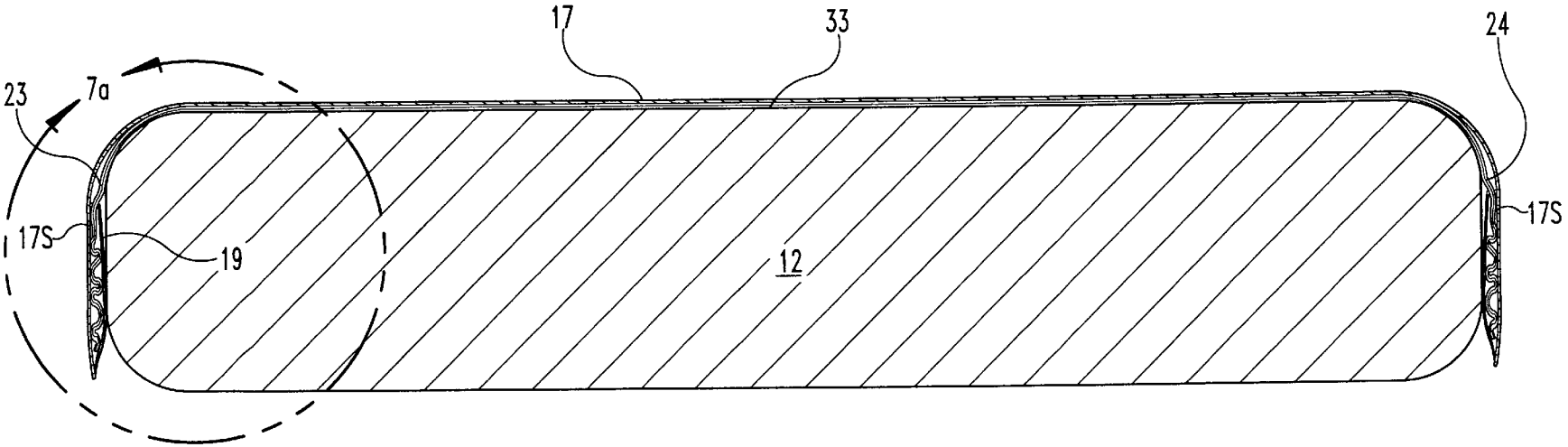
FIG. 7 is a section taken at line 7—7 in FIG. 4 and viewed in the direction of the arrows.
Figure 7A:
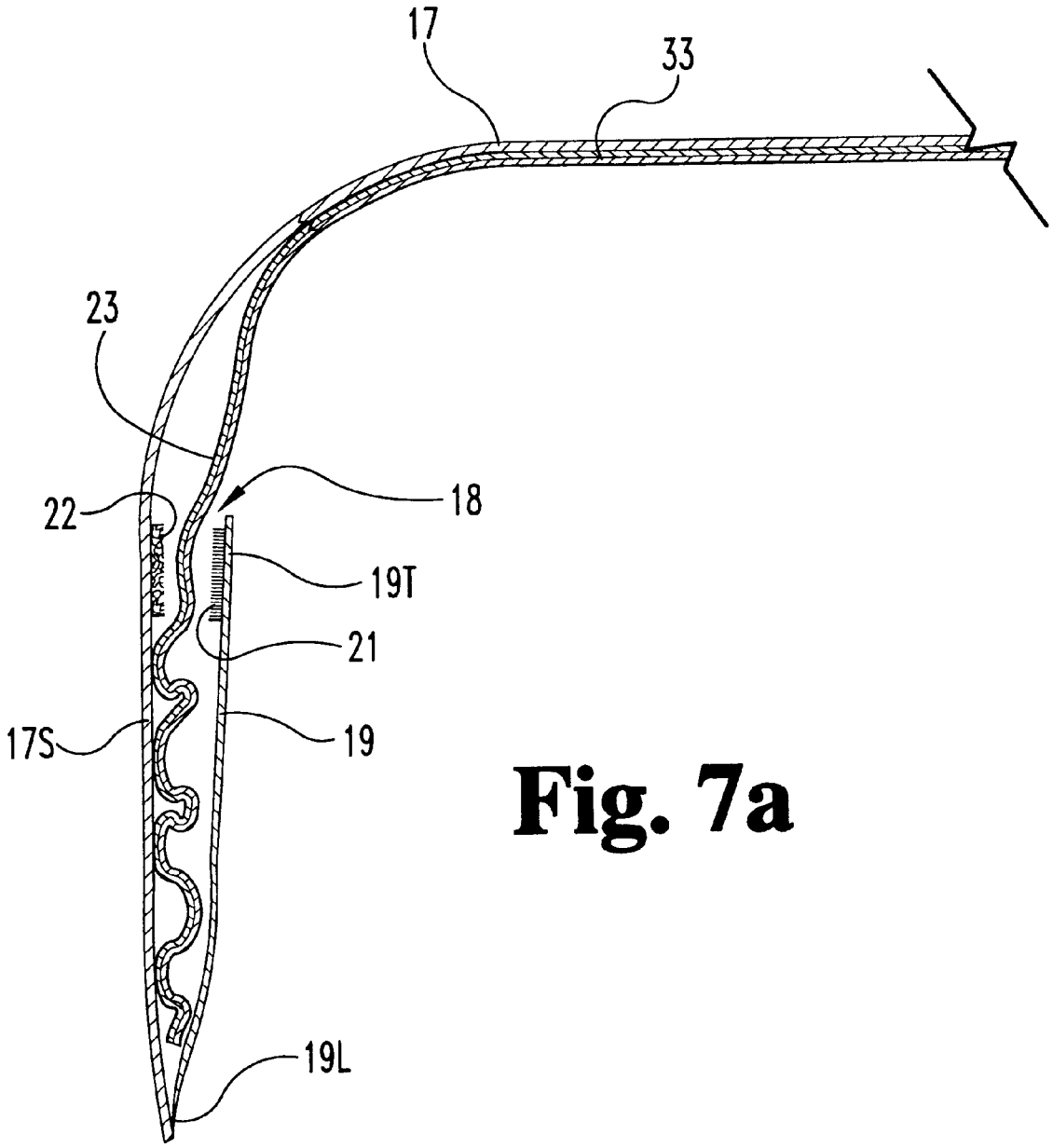
FIG. 7*a* is an enlargement of that portion of FIG. 7 encircled on FIG. 7.

Referring to FIG. 4 a top plan view shows the transfer device with the eight operating straps contained in hidden pouches. In contrast, FIG. 5 shows the same view with the operating straps extended. In the illustrated embodiment, and referring to FIG. 5 of the present invention, there are eight operating straps 23, 24, 26, 27, 28, 29, 31, and 32. Each of these is made of a strip of the same kind of material as that from which the sheet 17 is made. The strip is folded and stitched into a tube for additional strength, but nothing is placed inside the tube, so it is normally flat. For convenience, one tube will suffice for two straps. For example, straps 23 and 24 are made from a single tube which is stitched to the underside of the sheet entirely across the sheet at 33. Similarly, straps 26 and 27 are made of a single tube stitched to the underside of the sheet at 35. The rest of the straps are formed and secured to the sheet in the same way. Referring to FIGS. 7 and 7*a*, the proximal ends of these straps extend from their anchorage at the underside of the sheet top, down behind the sheet-stitched fastener strip 22 and in to the space between the sheet sides 17S and the pouch netting fabric 19. The straps are placed in the pouches and folded upon themselves as indicated in FIGS. 1 and 6 so as to neatly fit inside the pouches between the ends 18P of the pouches where the ends of the netting 19 are stitched to the sheet sides 17S. The straps are normally confined in the pouches by the pouch-top closure of the hook-and-loop connector strips 21–22.

Figure 3:
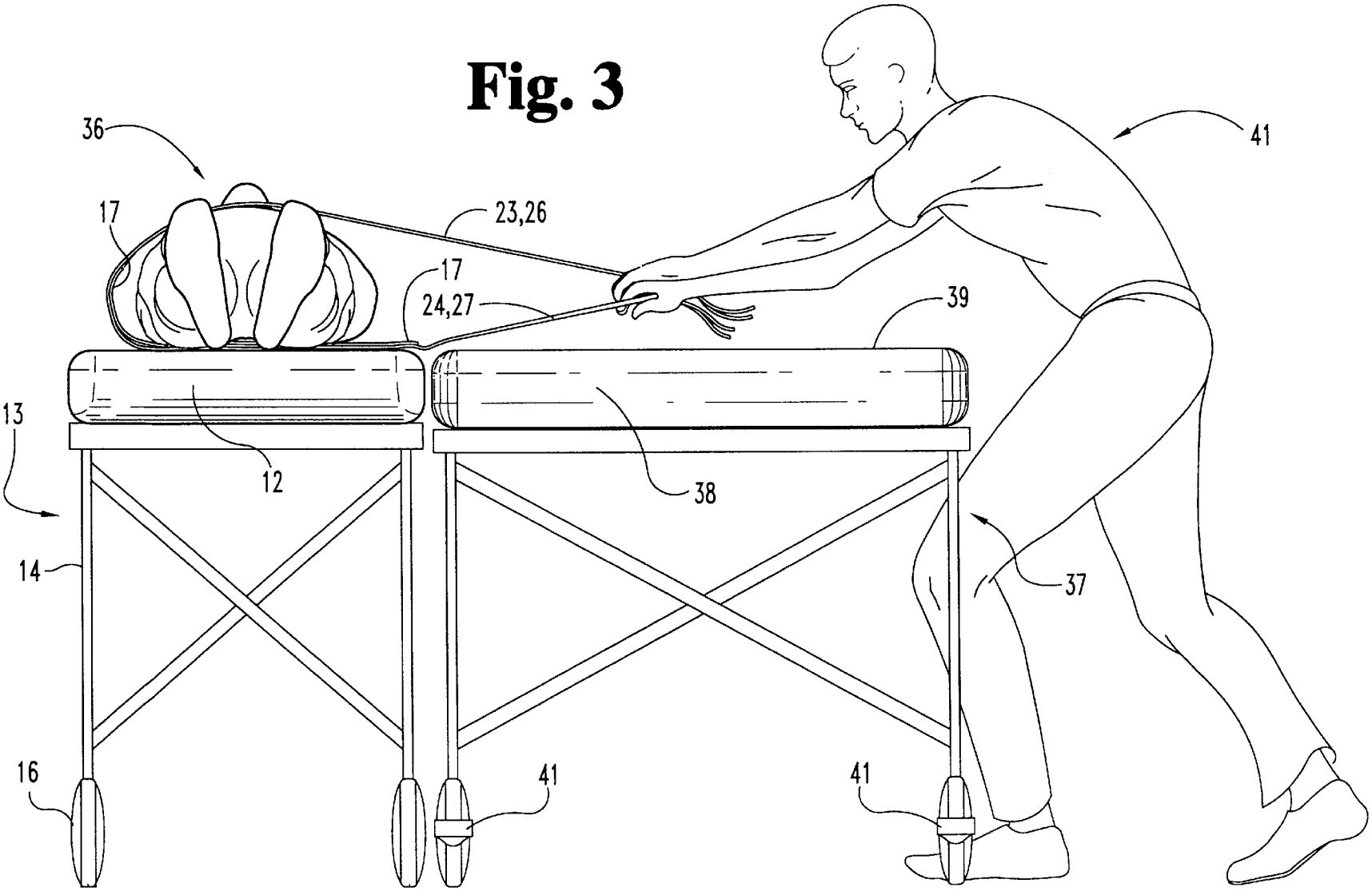
FIG. 3 is a schematic end elevational view showing a patient on an ambulance cot ready for transfer to a hospital bed by an attendant.
Figure 8:
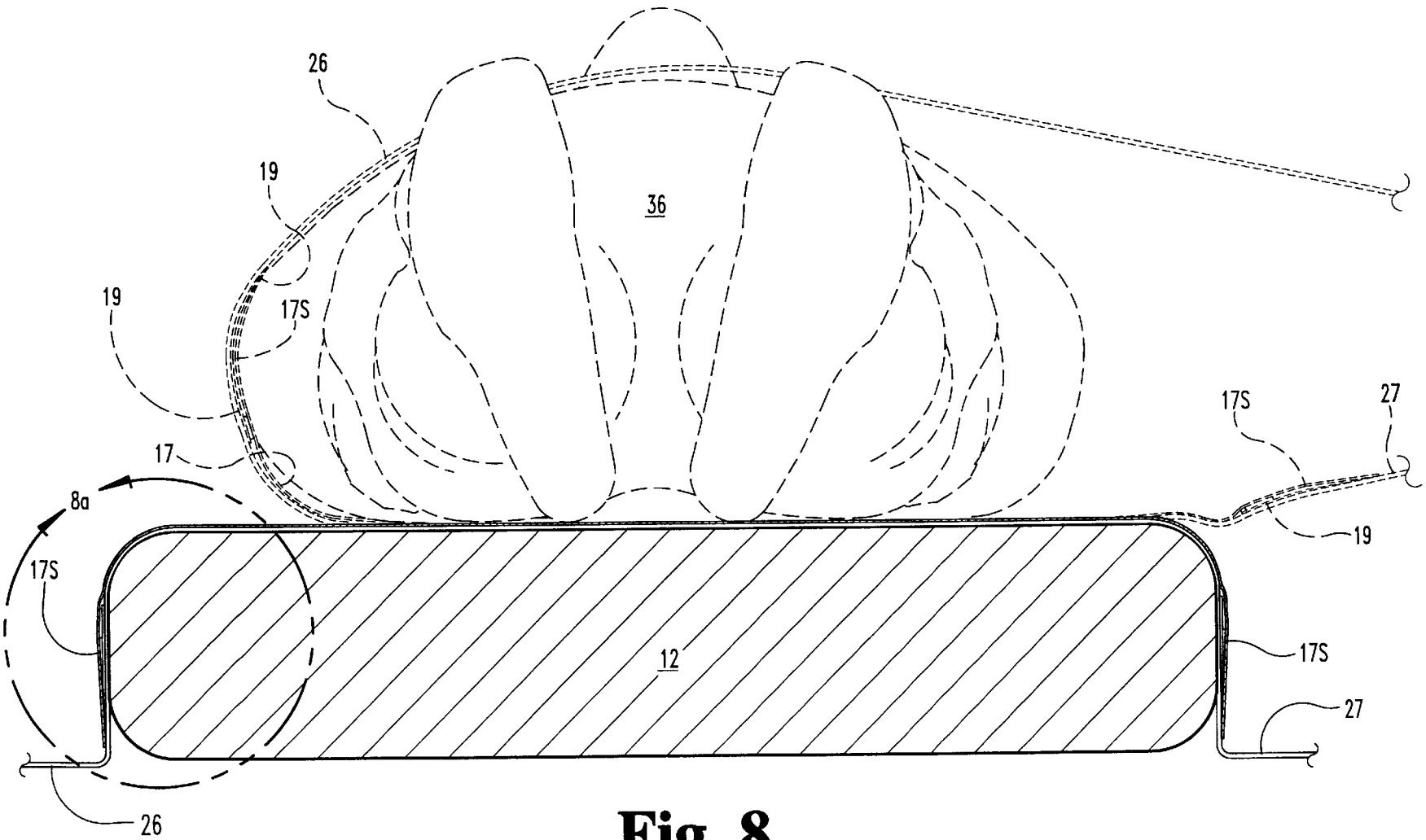
FIG. 8 is a section taken at line 8—8 in FIG. 5 and viewed in the direction of the arrows.
Figure 8A:
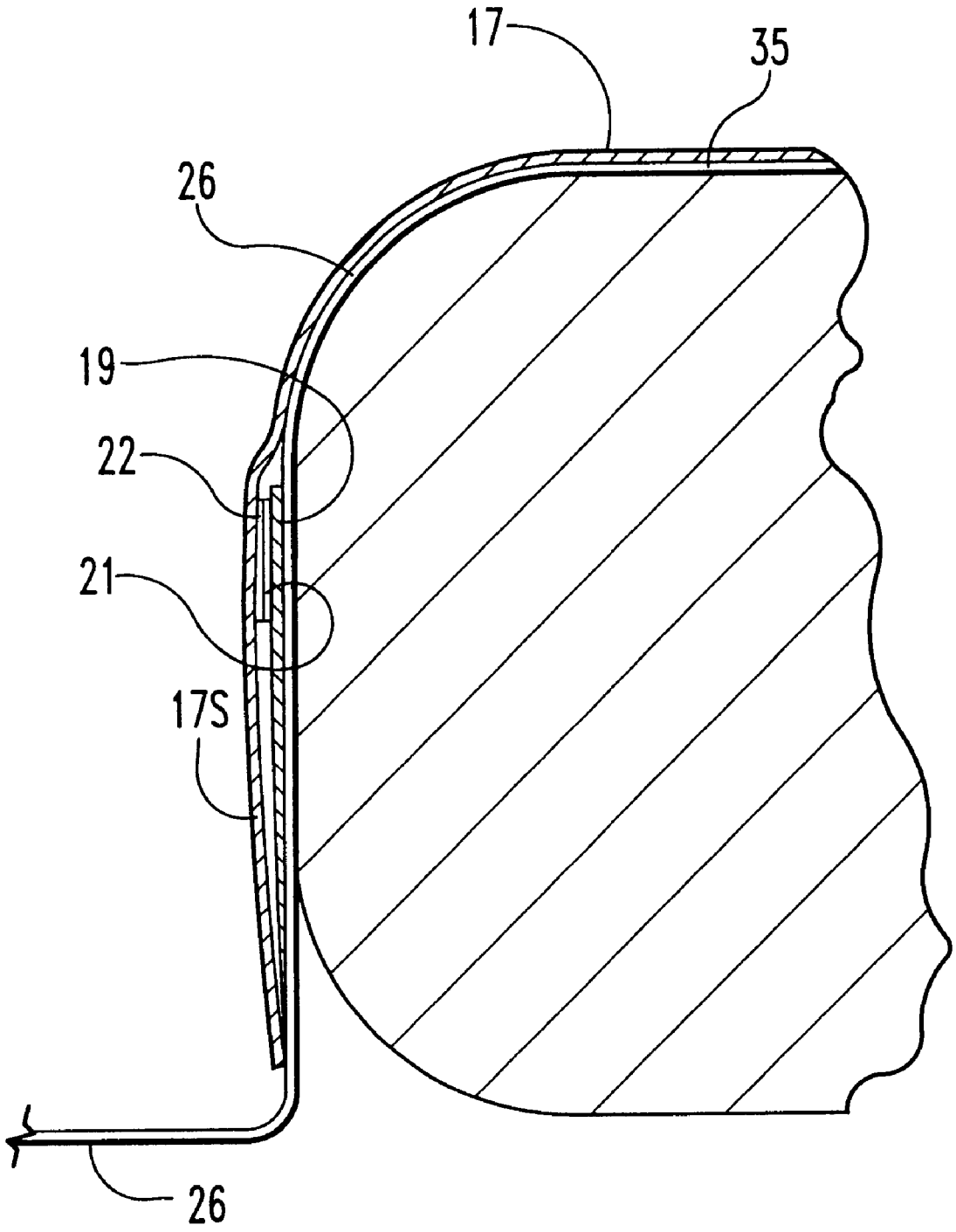
FIG. 8*a* is an enlargement of that portion of FIG. 8 encircled on FIG. 8.

In the use of the device, and assuming that the device is to be used to transfer a patient from the ambulance cot to a hospital bed, and referring to FIGS. 3 and 8, the patient 36 is resting on the sheet 17 fitted to the transferor cushion 12. The ambulance cot is rolled to a position adjacent the hospital bed 37. The patient is to be moved onto the transferee cushion 38 of the hospital bed and which itself, preferably, has a transfer sheet 39 thereon, although it can have a standard sheet on it, if desired.

To move the patient 36 from the ambulance cot to the hospital bed, preferably the wheel brakes 41, if the bed is so-equipped, are locked. The attendant opens the pouches on both sides of the sheet 17 by separating the strips 21–22, whereupon the ends of the straps can be pulled out of the pouches. All of the straps on the far side of the ambulance cot are pulled over the patient 36 and the sheet 39 on the hospital bed to where the attendant 41 is standing. As the straps on the far side are pulled, they pull the lower edge and the far side of the sheet 17 up (FIG. 3) and partially around (dotted lines, FIG. 8) and against the side of the patient. Similarly, the straps on the near side of the ambulance cot are pulled across over the sheet 39 on the hospital bed. These straps on the near side pull the lower edge and near side of the sheet 17 up (FIG. 3) and over the far side of the hospital bed sheet 39. Then, with the attendant gripping both straps 23 and 24, and straps 26 and 27, at essentially the same location relative to the patient, and another attendant (not shown) standing beside the attendant 41, gripping straps 28 and 29, and straps 31 and 32, respectively, at essentially the same location relative to the patient, they both pull simultaneously whereupon the sheet 17 with the patient thereon is pulled readily from the cot onto the hospital bed. Then, when the patient is safely on the hospital bed, the ambulance cot can be removed and attention given to the patient on the hospital bed. The sheet 17 can remain under the patient, if desired, or it can be removed from under the patient by conventional techniques such as normally used for changing sheets under a bed-ridden patient. Prior to that step, the straps can be returned to the pouches in the sheet 17, if more convenient to do so.

Since the above-mentioned material is readily launderable, this transfer device can be laundered for repeated use, if desired. When laundering it is best to stuff the straps back in the pouches before washing, to avoid a knotted batch of washed sheets. The fabric netting material is useful in this device for laundering purposes because it allows water and cleaning agents to reach the strap when the device is washed. On the other hand, if made as a single-use device, the straps can be cut-off and the sheet cut away from under the patient, if that is desired, rather than to move the patient off the sheet as mentioned above according to conventional sheet-changing techniques.

Alternatives to the long strips of hook and loop material to close the pouches are possible. Other types of fastener systems could be used. Also, with the netting as shown, or by omitting the netting and simply making the sides of the sheet longer and turning them up inside and stitching near the ends to form pouches, one small piece of hook and loop material or a bar-tack (stitching only to secure it) at the top center of the resulting side pocket or pouch, for stabilization of the pouch top could be used. To prevent tangling of straps from different sheets while washing a batch having this type of pouch, each sheet could have a net laundry bag that would allow for proper washing. This would use less or no, hook-and-loop material, resulting in a less stiff top edge of the pouch.

Figure 9:
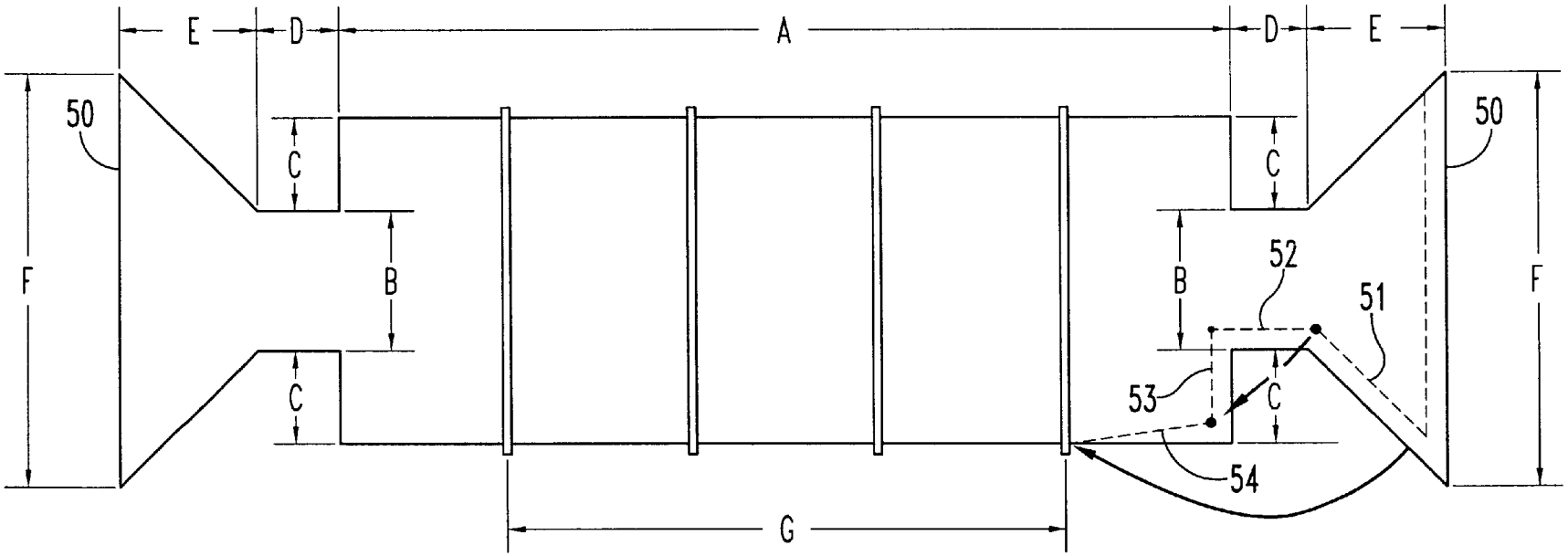
FIG. 9 is a diagram of the pattern of material used for the sheet portion of the transfer device.

Referring now to FIG. 9, there is disclosed the typical sheet dimensioning for various types, sizes and thicknesses of cushions. They are as follows: the sheet is primarily rectangular in shape with additional material on the lengthwise ends. The rectangular portion has a length (dimension A) equal to the length of the cushion minus 0.5 inches. Dimension A is slightly less than the length of the cushion to improve the aesthetics of the fit of the device on the cushion by snugging up the fit to give it a smoother finish when on the cushion. The rectangular portion has a width equal to the sum of the width (dimension B) of the cushion plus two times dimension C. Dimension C is equal to the height (thickness) of the cushion plus 1.25 inches so that when sewn the extra 1.25 inches will hug the bottom of the cushion sides and may even tuck under the cushion slightly so that the cushion does not show when the sheet is on it. The straps are tubular and continuous for strength and in the present embodiment are 1 inch to 1.25 inches wide. The straps are located across the width of the bed in four positions. In FIG. 9 they are found 6 inches and 20 inches to the right of the cushion's center in the lengthwise direction and 6 inches and 20 inches to the left of the cushion's center in the lengthwise direction. Thus dimension G is always 40 inches long and is centered at the lengthwise center of the rectangular portion.

Standard hospital bed mattress lengths range from 72 to 84 inches. The mattress heights range between 2 and 7 inches, and the widths range between 19 and 37 inches. But ambulance cots are usually shorter than standard beds, so the dimension G, and spacing between the straps may be less for ambulance cot sheets than for standard size bed sheets.

At one end the sheet extends outward in the lengthwise direction for a distance (dimension D) equal to the height of the cushion plus 0.5 inches. This outwardly extending portion of the sheet has a width (dimension B) equal to the width of the cushion and extends equally in both width directions around the widthwise center of the primary rectangle. The sheet continues to extend further from this lengthwise point outward in a lengthwise direction for a distance (dimension E) which is 9 inches on ambulance cots, 10 inches on cushions with a 75 inch length, and 10.5 inches on cushions with a length greater than 75 inches. While the fabric extends outward lengthwise it is also extending outward widthwise in a linear fashion so that at the end of the distance E the sheet has a width (dimension F) equal to the width (dimension B) of the cushion plus 17 inches. The attachment at the other lengthwise end is identical.

The elastic strip is along side 50 (FIG. 9). To attach, turn under 0.5 inches along 50 and sew elastic along the dotted line shown in FIG. 9. One method of sewing the remaining portions is to match 52 to 53 and 51 to 54 and sew along the dotted lines in FIG. 9 as indicated by the arrow. When sewing 52 to 53 match the large dots shown on FIG. 9, as indicated by another arrow, at the dot in between pivot and continue sewing 51 to 54. It is best to backstitch at the beginning and end of each seam for added strength. Since the sheet construction is symmetrical this process can be repeated at the other end.

The best overall strap length, from the side 17S at the top of the sheet, to the distal end of a strap, is between three feet and five feet, with a 4.7 foot length appearing to be the best standard for both sides of the sheet, as the user can grip the straps at any desired location along their length. But the strap should be at least twice the width of the cushion from which a patient is being transferred. The strap's width can be greater than 1.25 inches if desired. The preferred pouch end is 0.75 inches beyond the location of the end strap. The height of the pouch is preferably 3.5 inches or less, to accommodate the straps. The present invention is useful regardless of whether the cushions employ padding, foam, air, water or other materials in them.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A device for transferring a person from a transferor surface to a transferee surface comprising:

a sheet of material having a length and width of a size and construction to be placed on top and fit, in a contour sheet manner, an elongate transferor surface such as a cot or mattress, from which the person is intended to be transferred, and, a plurality of straps anchored to said sheet, said straps being of a length that is at least twice the width of the sheet so that they may be pulled entirely over said transferor surface and said person when lying on said sheet, and over a transferee surface such as a mattress positioned side-by-side with the transferor surface so that said straps may be gripped by an attendant standing at a side of said transferee surface.

2. The device of claim 1 wherein said sheet has longitudinally extending pouches at sides of said sheet.

3. The device of claim 2 wherein said pouches are formed by stitching a fabric netting material to said sheet and stitching two strips of hook-and-loop fastening material to said device, one strip being stitched to said sheet and its mating strip being stitched to an edge of said fabric netting material.

4. The device of claim 3 wherein said sheet is made of a medical fabric material.

5. The device of claim 3 wherein said sheet is a flexible and washable fabric.

6. The device of claim 1 wherein said straps are folded and stitched into a tube, and said tube may be continuous along the underside of said sheet from one side of said sheet to the other side of said sheet allowing one tube to suffice for two straps.

7. The device of claim 6 wherein said straps are made of the same kind of material as that from which said sheet is made.

8. The device of claim 7 wherein:

the transferor and transferee surfaces are on tops of transferor and transferee cushions, respectively, said sheet has a rectangular portion with sides and ends, and said sheet having additional material on the ends of said rectangular portion, said rectangular portion has a length equal to the length of said transferor cushion plus 0.5 inches, said rectangular portion has a width equal to the sum of the width of said transferor cushion plus two times the height of said transferor cushion plus 2.5 inches, said additional material on the ends of said sheet is identical on both ends, said additional material at each end has a first portion which extends outward from the end of said rectangular portion in the lengthwise direction for a distance equal to the height of said transferor cushion plus 0.5 inches and said outwardly lengthwise extending material has a width equal to the width of said transferor cushion and is centered widthwise around the widthwise center of said rectangular portion, and, said additional material has a second portion which further extends outward from the first portion in the lengthwise direction for a distance of 9 inches when said transferor cushion is an ambulance cot, 10 inches when sad transferor cushion is a mattress with a 75 inch length, and 10.5 inches when said transferor cushion is a mattress which has a length greater than 75 inches.

9. The device of claim 8 wherein there are four of said straps, said straps being positioned symmetrically around the lengthwise center of said rectangular portion, said straps being located approximately 6 inches and 20 inches from said lengthwise center, said straps extending across said rectangular portion in the widthwise direction.

10. The device of claim 1 and wherein said transferor and transferee surfaces are on tops of transferor and transferee cushions, respectively, the device further comprising:

a pouch attached to each of what would be the sides of said sheet when said sheet is fitted to said transferor cushion, wherein said pouches are formed by stitching a fabric netting material to said sheet and stitching two strips of mating hook-and-loop fastening material to said device, one strip being stitched to a side of said sheet and its mating strip being stitched an edge of said fabric netting material, and, wherein in using the device the transferor cushion is positioned adjacent the transferee cushion, two attendants open said pouches by separating said mated strips of hook-and-loop fastening material whereupon portions including the free ends of said straps are readily removable from said pouches, said two attendants position themselves on the side of the transferee cushion away from the side adjacent to said transferor cushion, said two attendants each grip one strap from each side of said device in each hand, and said two attendants simultaneously pull whereupon said sheet with said person thereon is pulled readily from said transferor cushion to said transferee cushion.

11. The combination comprising:

an elongate first cushion for support of an immobile person, and having a top and a bottom and ends;

a transfer device mounted on the cushion to facilitate transfer of the person from the first cushion to another, second cushion and comprising:

a sheet over the top of the first cushion;

the sheet having end portions extending down around the ends of the first cushion and under the bottom of the first cushion;

straps attached to the sheet at spaced locations between the end portions; and strap storage devices attached to the sheet to normally store the straps adjacent the sheet;

the straps having portions movable from the storage devices to locations spaced from the sheet.

12. The combination of claim 11 and further comprising:

resilient features at the end portions to resiliently retain the end portions in place under the bottom of the first cushion.

13. The combination of claim 11 and wherein:

the storage devices include walls confining the straps to defined locations on the sheet.

14. The combination of claim 13 and wherein:

the storage device walls include portions of the sheet beside the first cushion.

15. The combination of claim 14 and wherein:

the storage device walls include screen material secured to the sheet beside the first cushion and cooperating with the sheet portion beside the cushion to provide storage compartments for portions of the straps.

16. The combination of claim 15 and wherein:

the screen material is netting, and the netting and sheet portion beside the cushion have hook-and-loop fasteners to hold the compartments closed to confine the strap portions in the compartments.

17. The combination of claim 16 and wherein:

the netting is fastened to a lower edge of the sheet at each side of the cushion and the hook-and-loop fasteners are fastened to the sheet and the netting adjacent a top edge of the netting at each side of the cushion to make the compartments in the form of pouches closeable at the top of the netting by mating the fasteners.

18. The combination of claim 17 and wherein:

the straps are anchored to the underside of the sheet between the cushion and the sheet and have portions stored in the pouches.

19. The combination of claim 18 and wherein:

the stored portions of the straps are movable from the pouches to locations spaced from the sides of the cushion a distance at least as great as two times the width of the cushion.

20. A method for transferring an immobile person from a first cushion to a second cushion and comprising the steps of:

placing the cushions side-by-side;

pulling from the sides of a sheet under the person on the first cushion, a plurality of straps anchored to said sheet;

standing at the side of the second cushion remote from the first cushion;

pulling straps at the far side of the first cushion entirely over said person lying on the first cushion and over at least a part of the second cushion;

pulling straps at the near side of the first cushion over at least a part of the second cushion;

continuing pulling the straps simultaneously and the sheet and person therewith from the first cushion to a position supported on the second cushion.

21. The method of claim 20 and further comprising the steps of:

prior to pulling the straps, removing portions of the straps from storage in the sheet.

22. The method of claim 21 and further comprising the step of:

prior to removing portions of the straps, opening strap storage pouches by separating mating strips of hook-and-loop fasteners.

23. The method of claim 22 and further comprising the steps of:

prior to pulling the straps simultaneously, pulling out from under the first cushion, portions of the ends of the sheet under the bottom of the first cushion.

* * * * *